United States Patent [19]

Ladin

[11] Patent Number: 4,894,913

[45] Date of Patent: Jan. 23, 1990

[54] STRAP CUTTING TOOL

[76] Inventor: Eli M. Ladin, 1608 Morton, Ann Arbor, Mich. 48104

[21] Appl. No.: 159,196

[22] Filed: Feb. 23, 1988

[51] Int. Cl.[4] ..... B26B 11/00; B25G 1/00

[52] U.S. Cl. ..... 30/134; 30/341

[58] Field of Search ..... 30/134, 135, 124, 173, 30/194, 85, 2, 517, 341; 16/101 R; 81/489–492; 56/328 R, 329

[56] References Cited

U.S. PATENT DOCUMENTS 2,511,187 6/1950 Weidauer ..... 30/341 X

*Primary Examiner*—Douglas D. Watts

*Attorney, Agent, or Firm*—Alex Rhodes

[57] ABSTRACT

A heavy-duty industrial tool has a working jaw mechanism operated by a pair of handles that are squeezed together. The upper handle has a main non-metallic handle member to whose sides are fastened a pair of stamped metal side members. These side members are in-laid into recesses in the sides of the non-metallic member to form a gripping portion. Forwardly of the gripping portion, the widths of the metallic members increase to form a throat within which the lower handle is pivotally mounted. The lower handle contains a stack of laminations, including a cutting blade that is forward of the pivot to form the upper jaw of the tool. The lower jaw is an anvil member that joins to flanges of the metal side members of the upper handle. When the tool is used to cut tensioned strapping, a resilient metal bracket attached to the blade presses the strapping against the anvil on opposite sides of the blade and deforms to absorb energy that is released by the strapping upon severing.

36 Claims, 3 Drawing Sheets

STRAP CUTTING TOOL

BACKGROUND AND SUMMARY OF THE INVENTION

This invention relates generally to a strap cutting tool of the type used to cut tensioned strapping. In some respects, this invention is an improvement upon the strap cutting tool disclosed in the Applicant's prior Pat. No. 4,644,646 issued Feb. 24, 1987. In other respects, principles of the invention may be applied to similar types of tools that have a working mechanism operated by a pair of handles which are squeezed together.

Problems related to the cutting of tensioned strapping are described in the aforementioned patent. The strap cutting tool disclosed in that patent comprises energy absorbing structures at lateral sides of the cutting mechanism which absorb energy released from the tensioned strapping upon severing. The energy absorbing elements prevent uncontrolled whipping of the severed ends of the strapping from the tool by means of their strategic configuration and arrangement on the tool. The disclosed energy absorbing structures are elastomeric bodies disposed on laterally opposite sides of the cutting mechanism and mounted on the cutting blade by a laterally extending support member attached to the top of the blade. An anvil portion of the tool underlies the energy absorbing structures and contains a centrally disposed slot having an edge with which the cutting edge of the blade coacts to sever strapping when the strapping is disposed between the anvil and the blade, and the tool handles are squeezed together. The energy absorbing structures forcefully hold the strapping against the anvil, compressing in the process, while retaining columnar stability in the direction of force application to the strapping. Upon severing, the energy that has been stored in the tensioned strapping is absorbed into the energy absorbing structures by their laterally yielding while they continue to forcefully hold the severed ends of the strapping against the anvil. In this way, the uncontrolled release of energy in the strapping upon severing is avoided.

One aspect of the present invention relates to improvements in the energy absorbing structures for a strap cutting tool of the type that is disclosed in the aforementioned patent.

While use of elastomeric elements as described in that patent still continue to be preferred, it has been found possible to fabricate energy absorbing structures of suitable resilient metals, such as spring steel, that are formed into particular configurations. Several configurations are specifically disclosed for purposes of explaining principles of this aspect of the present invention.

Other principles of this invention relate to improvements in the fabrication of the tool, and these principles are applicable to various forms of pliers-type tools in addition to the disclosed strap cutting tool.

The tool of Pat. No. 4,644,646 comprises a pair of members pivotally connected together about a pivot. Each member comprises a handle portion and a jaw portion. One member has a lower jaw portion and an associated upper handle portion; the other, an upper jaw portion and an associated lower handle portion. As the handle portions are squeezed together, the resultant action about the pivot results in the jaw portions being closed together to perform the cutting operation. Such a construction contemplates the two members being fabricated as metal forgings. Forging is a process that produces a strong part, but for mass production purposes, it may be too slow to be economical because forgings require subsequent costly machining operations.

Accordingly, the present invention also relates to a novel and unique construction which is particularly well-suited for economical mass production fabrication of a heavy duty industrial pliers-type tool, such as embodied in the disclosed strap cutter. Moreover, these principles allow for the fabrication of a tool which is: esthetically pleasing in design; ergonomic; and functional. Novel features reside in the construction of the handles, the anvil and the blade and in the manner of assembly of the several parts.

The foregoing, along with additional features, advantages and benefits of the invention, will be seen in the ensuing description and claims which are accompanied by drawings. The drawings disclose a preferred embodiment of the invention according to the best mode contemplated at the present time in carrying out the invention.

DESCRIPTION OF THE PREFERRED EMBODIMENT

Figures 1, 2:
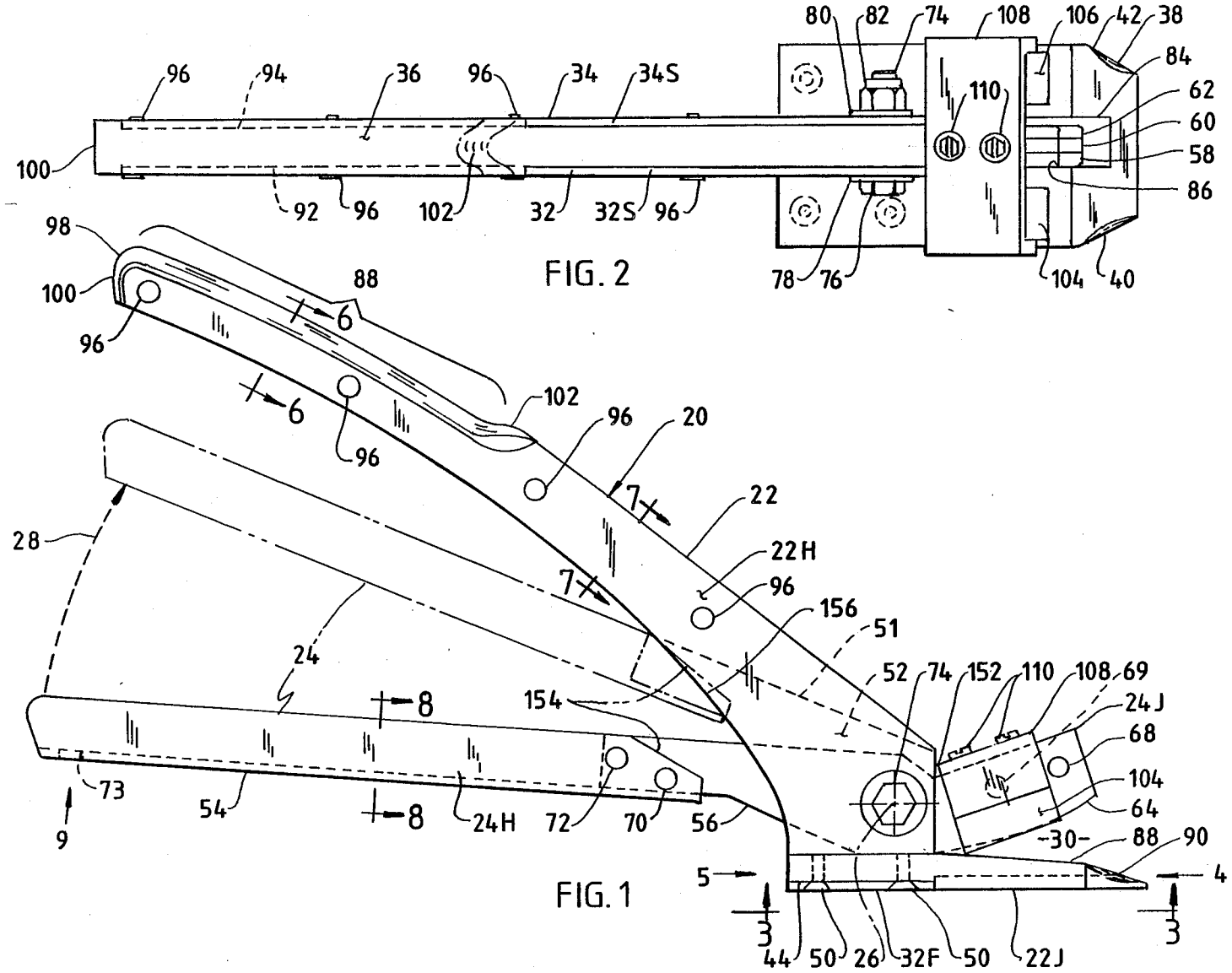
FIG. 1 is a side elevational view of a strap cutting tool embodying principles of the present invention.
FIG. 2 is a top view of FIG. 1.
Figure 3:
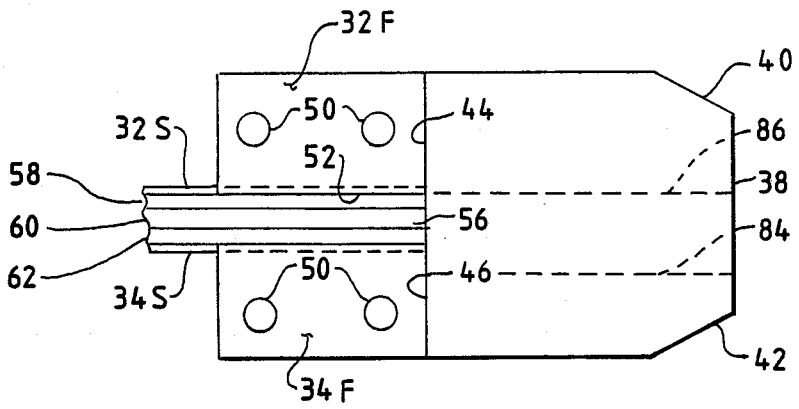
FIG. 3 is an enlarged fragmentary view taken generally in the direction of arrows 3—3 in FIG. 1.
Figure 4:
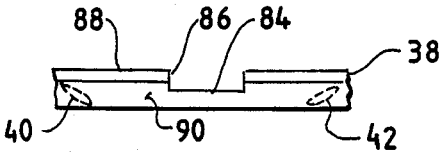
FIG. 4 is an enlarged view taken generally in the direction of arrow 4 in FIG. 1.
Figure 5:
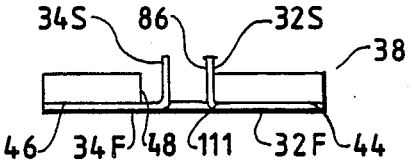
FIG. 5 is an enlarged view taken generally in the direction of arrow 5 in FIG. 1.
Figure 6:
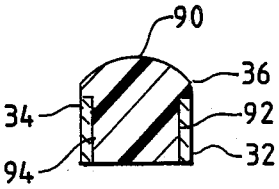
FIG. 6 is an enlarged transverse cross sectional view taken in the direction of arrows 6—6 in FIG. 1.
Figure 7:
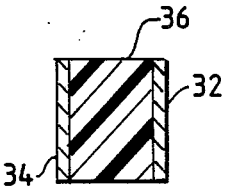
FIG. 7 is an enlarged transverse cross sectional view taken in the direction of arrows 7—7 in FIG. 1.
Figure 8:
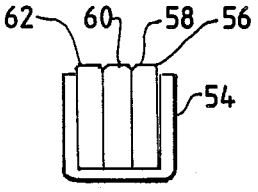
FIG. 8 is an enlarged transverse cross sectional view taken in the direction of arrows 8—8 in FIG. 1.
Figure 9:
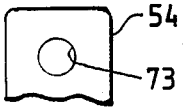
FIG. 9 is an enlarged fragmentary view taken in the direction of arrow 9 in FIG. 1.
Figure 10:
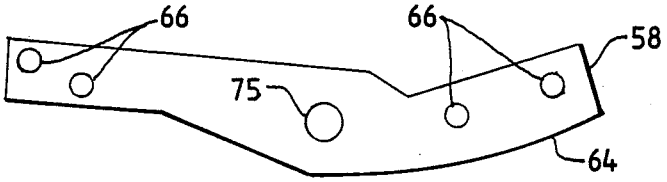
FIG. 10 is a side elevational view of the cutting blade shown by itself.
Figure 11:
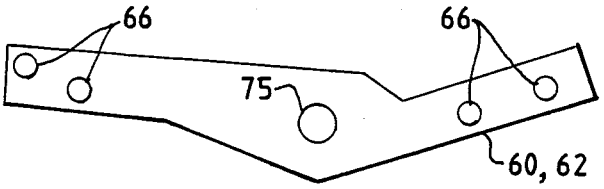
FIG. 11 is a side elevational view of another portion of the cutting mechanism associated with the blade.

FIGS. 1 and 2 illustrate a strap cutting tool 20 embodying principles of the present invention. FIGS. 3–11 illustrate additional details.

The strap cutting tool is a pliers-type device comprising two assemblies 22 and 24 that are pivotally connected together about a pivot 26. Each assembly 22, 24, comprises a corresponding handle portion 22H, 24H and a corresponding jaw portion 22J, 24J. Handle portion 22H is considered the upper handle while handle portion 24H is considered the lower handle. Jaw portion 24J is considered the upper jaw while jaw portion 22J is considered the lower jaw. The solid line position illustrated in FIG. 1 shows the jaws open.

When the handles are grasped and squeezed together, such as in the manner portrayed by the arrow 28 representing relative movement of the lower handle toward the upper handle, the two jaws are urged together about pivot 26. Such action will serve to sever a piece of metal strapping (not shown) that is placed in the area designated by the numeral 30 in FIG. 1.

Assembly 22H comprises a pair of metal side members 32, 34, a non-metallic handle member 36, and a metal anvil 38. Members 32, 34 and 36 are generally elongate and serve to form the entirety of upper handle 22H. Each of the side members 32, 34 may be considered to comprise two portions: one, a flat side portion 32S, 34S, respectively, that is disposed flat against a corresponding lateral side of handle member 36; and two, a flat flange portion 32F, 34F, respectively, (see FIGS. 3 and 5) that provides for the attachment of anvil 38. Each side portion 32S, 34S is planar; so are the corresponding flange portions 32F, 34F, respectively, but each is disposed outwardly at a right angle to the corresponding side portion 32S, 34S, and is connected by a curved bend to the corresponding side portion.

In plan, anvil 38 has a generally rectangular shape although the two leading, or forward, corners have tapers 40 and 42, respectively. The trailing, or rearward, corners are provided with rectangular recesses 44, 46, but only in the lower surface of the anvil. These recesses 44 and 46 have areas and depths corresponding essentially to the areas and thickness of flanges 32F and 34F. A rectangular slot 48 in the anvil allows that portion of upper handle 22H that is immediately contiguous flanges 32F and 34F to fit between the two sides of the anvil that contain the respective recesses 44, 46. The two flanges fit in a generally flush manner in the two recesses, and secure attachment is accomplished by any suitable means, such as screws or rivets 50, two per flange, which pass through aligned holes in the flanges and the corresponding portions of the anvil.

Handle member 36 is not fully coextensive in length with the side portions 32S, 34S in the direction toward pivot 26 and anvil 38. Member 36 terminates in an angled surface designated by the reference numeral 51 in FIG. 1. Accordingly, a throat area 52 is defined between members 32 and 34 immediately contiguous flanges 32F, 34F and anvil 38. Assembly 24 passes through this throat area 52, and the pivot 26 between the two assemblies 22 and 24 is also provided in this area.

Assembly 24 comprises a handle member 54 and a stack of laminations, 56 generally. There are three laminations in stack 56, one of which is a blade element 58, shown by itself in FIG. 10, and the remaining two of which, elements 60, 62, are identical in shape as portrayed in FIG. 11. Blade element 58 possesses a convexly curved cutting edge 64. The shapes of elements 60, 62 are congruent with that of blade element 58 except along cutting edge 64 where the elements 60 and 62 are relieved to provide clearance for edge 64. Registering hole patterns 66 are provided in elements 58, 60 and 62, and the three elements are secured together in lamination by rivets 68, 69 at the two registered holes forward of pivot 26 and by rivets 70 and 72 which pass not only through the two registered holes rearward of pivot 26 but also through registering holes in the sides of handle member 54 thereby securely joining the latter to the stack 56. It can be seen in FIG. 8 that handle member 54 has a generally U-shaped transverse cross section whose throat is dimensioned to fit closely onto the end portion of the laminated elements that points away from pivot 26.

With the organization and arrangement of the two elements 60 and 62 relative to element 58, the cutting edge 64 is allowed to protrude free and clear for effective action in cooperation with the anvil in cutting strapping placed between the two jaws 24J, 22J that are formed by the lamination stack and the anvil. Near the distal end of handle member 54 is a small hole 73 that allows the tool to be hung on a hook or a nail when not in use.

Pivot 26 comprises a fastening mechanism, 74 generally, that passes through registering holes 75 in stack 56 and the side portions 32S, 34S of members 32, 34. The fastening mechanism comprises a headed screw 76 with a washer 78 disposed between the head of screw 76 and one of the side members 32, 34. The shank of screw 76 passes through the registering holes to protrude from the opposite side. A washer 80 is fitted over the protruding end of the screw shank, and a prevailing torque look nut 82 is threaded onto the screw shank and tightened to secure the two assemblies 22, 24 in pivotal mounting. The nature of the fastening action of mechanism 74 is such that the fastening mechanism does not rotate with respect to assembly 22 when the handles are operated; rather, assembly 24 rotates on the screw shank, and thus all relative movement about the screw shank takes place within the confines of throat area 52.

Anvil 38 contains a channel-shaped groove 84 that extends forwardly from slot 48. The groove's width is equal to that of slot 48 minus essentially the thickness of member 32. The reduction in width is on the left side of groove 84 as viewed in FIG. 4 so that the left edge 86 of groove 84 as seen in that FIG. is juxtaposed for coaction with edge 64 of blade 58 for cutting strapping. In addition to the tapered corners 40, 42, the anvil has its top surface provided with a rather gradual taper 88 that is generally coextensive with the line of action of edge 64 along groove 84. This gradual taper merges into an increased taper 90 at the forward end of the anvil, and its purpose is to facilitate lodging of the anvil beneath a tensioned strap that is to be severed. Advantageously, the anvil is a one-piece element that can be manufactured by conventional procedures and also easily machined to provide a satisfactory sharpness for edge 86.

Upper handle 22H comprises a gripping portion, 88 generally. This gripping portion is adapted for spanning the palm of the hand when the tool is grasped and the handles are squeezed together. For this purpose, the gripping portion has a slightly convexly curved shape as viewed in FIG. 1, and as perhaps best seen in FIG. 6, the exposed top surface of handle member 36 is rounded (numeral 90) while the side members 32 and 34 are inlaid into complementary contoured recesses 92, 94 in the sides of member 36 so that side members 32, 34 are substantially flush with handle member 36.

Members 32, 34, 36 are securely joined in assembly by a series of four rivets 96 arranged as shown at increments along the length of the handle. At the extreme distal end of gripping portion 88 in the direction away from pivot 26, the transversely rounded upper surface of member 36 is also rounded in the distal sense (numeral 98) to extend downwardly in covering relation (numeral 100) to the distal ends of side members 32, 34. Member 36 is proportioned relative to side members 32, 34 along gripping portion 88 such that when the handles ar grasped and squeezed together, the squeezing force that is exerted by the palm of the hand on the upper handle member is distributed essentially on the rounded top surface of handle member 36.

Moreover, the gripping portion 88 is configured to have a raised stop 102 at the end thereof that is toward pivot 26. This stop is adapted to fit in the area between the base of the thumb and that of the index finger to resist any tendency of the user's hand to slide forwardly along the handles as they are being squeezed.

A pair of energy absorbing structures 104, 106 are disposed to each lateral side of blade 58. These structures are attached to the ends of a laterally extending metal support plate 108 which is attached centrally to the top side of the stack of laminations forwardly of pivot 26. Screws 110 pass through clearance holes in support plate 108 and into tapped holes in the laminated stack.

The energy absorbing structures are in the form of elastomeric elements of the type described in patent 4,644,646. As such, when tensioned strapping is placed between the open jaws and the handles are squeezed together, elements 104, 106 press the strapping against the underlying anvil to each side of blade 58 as the blade is severing the strapping. As the severing is being completed, the energy of tension that has been stored in the strapping is absorbed by elements 104, 106, yielding laterally to absorb the energy while still holding the severed ends of the strapping forcefully against the anvil. In this way, the undercontrolled whipping of the severed ends from the tool is avoided. Further description and details of the elastomeric elements may be had by reference to patent 4,644,646.

The strap cutting tool 20 is advantageous for mass production fabrication because many of its parts are metal stampings which can be economically and rapidly produced. The stamped metal parts are the side members 32, 34, the handle member 54, the lamination members 58, 60, 62, and the support bracket 108. Such parts have precise thicknesses, are stamped to finished shapes, and require minimal secondary operations, if at all. For one example, the stamping of the metal side members 32, 34 provides their finished shape, including the formation of the required holes and the outward turning of the flange portions 32F, 34F. For another example, a single die can be used to fabricate elements 58, 60, 62 even though elements 60, 62 have a different shape along the edge that is next to the blade edge 64 of element 58; this is done by designing the basic die for stamping element 58, and then whenever elements 60, 62 are to be stamped, a suitable insert is placed into the basic die. Since element 58 and anvil 38 are the sole parts that have cutting edges, only they need be made of harder, and more costly, intermediate to high carbon steel; other metal parts, such as elements 60, 62 and side member 32, 34 can be made of less hard and less costly steel.

While the anvil is a one-piece member that can be economically fabricated by conventional techniques, investment casting of this part provides special benefits, and it is the preferred procedure for making the anvil. The anvil can be fabricated to the shape that has been illustrated and described, and then all that need be done is to finish the cutting edge 86 to the desired sharpness. Note that investment casting provides for the rounding off of the corner tapers 40, 42 into the tapered surface 90; this feature facilitates the insertion of the anvil beneath tensioned strapping because rounding promotes a more gradual flexing of the strapping where the rounding contacts the strapping as the anvil is being inserted beneath the strapping.

The various fasteners, including those used for the pivot 26, are also conventional parts.

Although the tool is fabricated of a number of stamped metal parts, there are a number of inventive features in the organization and arrangement that lead to a construction well-suited for a heavy-duty industrial-type hand tool.

The pliers-type action of the tool imposes bending loads in the handles and jaws. The members take advantage of the high tensile strength of steel in resisting these loads. The laminated stack 56 and the anvil 38 possess high strength because they are steel and they have significant thickness.

Although they are thinner than stack 56 and anvil 38, the stamped side members 32, 34 are arranged to have a high moment of inertia in the direction of the bending loads. Forwardly from the forward end of gripping portion 88, where the closing forces are amplified, the width of members 32, 34 progressively increases. Although their widths are less along the gripping portion, side members 32, 34 have a rigid cooperative coaction with member 36, as received in contoured recesses 92, 94 and joined to member 36, especially during bending, along the upper edge of each side member which is disposed against the corresponding edge of the corresponding recess 92, 94. Two rivets 96 attach the side members to the handle member along gripping portion 88 while the two remaining forward rivets 96 resist the bending moment couple that is transmitted along the handle during strap cutting.

The tool further resists bending action during cutting by the manner in which flanges 32F, 34F are arranged and attached to anvil 38. During strapping cutting, the bending moments in the tool tend to bend the fronts of flanges 32F, 34F upwardly. By placing these flanges underneath the anvil, the peak forces on the fasteners 50 at each flange are reduced from what would be the case if the flanges were on top of the anvil, particularly for the front fasteners, both of which are nearer pivot 26, and especially the front fastener that is nearer blade 58 where the bending moment is greatest.

Not only is flange 32F in full abutment with the anvil, but moreover, the portion of side 32S that is immediately contiguous flange 32F is essentially in full abutment with the side of groove 84, a further strengthening feature of the tool. This two-sided abutment of member 32 with anvil 38 is achieved by incorporating a small chamfer 111 along the lower edge of the side of groove 84 to accommodate the curved bend that joins flange 32F and side 32S in member 32.

Member 36 is preferably a suitable non-metallic structural material that can be mass produced by conventional techniques such as molding. A preferred material is glass-filled or glass-reinforced nylon. Such a material is structurally very strong, dimensionally stable, and yet can be formed with comfortable rounded contours particularly in the area of gripping portion 88. Assembly of the various component parts can be expeditiously accomplished using conventional assembly techniques and procedures. Therefore, a tool fabricated in accordance with the present invention is in certain respects more cost-effective for mass production than the tool that is the subject of the Applicant's prior Pat. No. 4,644,646. The construction of the handles is a feature which can be used in various forms of pliers-type tools other than the illustrated strap cutting tool.

Figure 12:
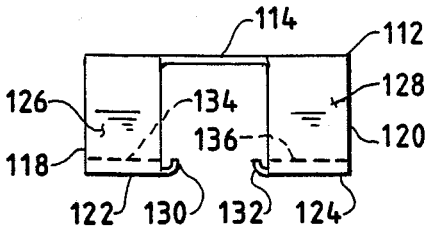
FIG. 12 is a front elevational view of a modified embodiment of one portion of the cutting tool.
Figure 13:
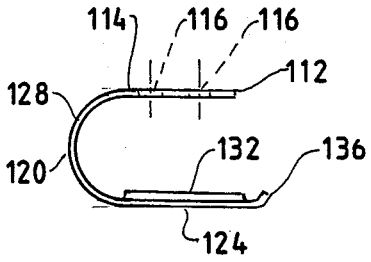
FIG. 13 is a side elevational view of FIG. 12.
Figure 14:
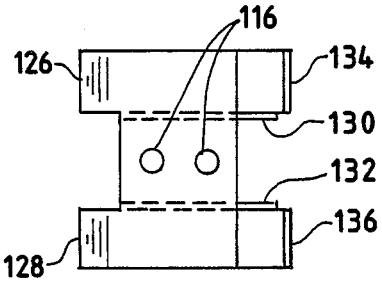
FIG. 14 is a top plan view of FIG. 12.

Further features of the invention more specific to a strap cutting tool are illustrated in FIGS. 12 through 17. FIGS. 12–14 illustrate a second embodiment of energy absorbing structures in the form of a one-piece spring steel part 112. Part 112 is intended to be substituted for the energy absorbing structures 104, 106 and the support plate 108 in tool 20.

Part 112 comprises a top laterally extending portion 114 with a pair of holes 116 for use in attachment by screws 110 to the top of stack 56. The part further comprises laterally spaced apart leaf sections 118, 120 that correspond to the resilient elastomeric elements 104, 106. Each leaf comprises a pad 122, 124 that is spaced vertically below and disposed generally parallel to section 114. A curved bend 126, 128 integrally joins the forward, or leading, portion of each pad 122, 124 with a corresponding edge portion of section 114. Curved upturned lips 130, 132 are provided along the edge portions of the two pads 122, 124 that face each other across the opening between the pads that is provided for the cutting mechanism. Additionally, the trailing edge of each pad is provided with an upturned lip 134, 136.

With part 112 securely attached to the tool, it will function to prevent the uncontrolled whipping of the ends of a severed strap from the tool by absorbing a substantial portion of the energy that is released by the strap upon severing. As the tool is operated to sever the strapping, pads 122, 124 are pressed against the strapping to each side of the line of severing. As the jaws close further, the force pressing on the strapping increases because it is necessary for part 112 to deflect as the jaws are being closed. The exact manner of deflection will depend upon the particular geometry, thickness, and spring characteristics of part 112. In general, the deflection during jaw closing and before completion of severing will take place in the curved sections 126, 128 and in bending of section 112 about its point of attachment to the stack 56. During this time, the pad continues to press the strapping forcefully downwardly against the underlying anvil still constraining the strapping against movement on the anvil.

As the severing is completed, the energy that has been stored in the tensioned strapping is released. Because the force of part 112 still continues pressing the severed ends of the strapping against the anvil, a substantial portion of the released energy is absorbed by a further deflection or deformation in part 112, due to slight lateral outward displacement of the pads in response to the laterally outward forces in the severed ends of the strapping. The particular deformation once again is a function of the particular shape, thickness, spring characteristics, etc. of part 112. In this way, the uncontrolled whipping of the severed ends of the strapping from the tool is resisted.

The lips 130, 132, 134, 136 serve two purposes: one, they stiffen the pads 122, 124 so that they tend to remain flat when pressing the strapping against the anvil; two, they also serve to facilitate removal of strapping from the tool thereby minimizing the tendency for an edge of the strapping to hang up on an edge of the pad.

Figure 15:
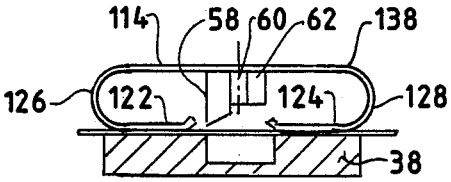
FIG. 15 is a cross sectional view looking generally in the same direction as the view of FIG. 12 but illustrating the action of another modified embodiment during a strap cutting operation.

FIG. 15 shows another modified embodiment 138 for the energy absorbing structures which is similar to part 112. Like reference numerals are used to designate corresponding parts in both part 112 and part 138. The principal difference between part 112 and part 138 is that in part 138 the curved sections 126, 128 join the lateral side edge portions of the top section 114 with the outboard lateral edge portions of the pad. Part 138 resiliently deforms during the strap cutting operation to press the strapping against the underlying anvil and then to absorb a substantial portion of the tensioned energy that is released from the strapping upon severing.

Figure 16:
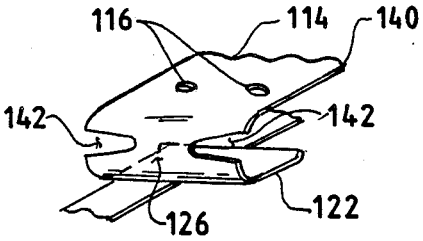
FIG. 16 is a fragmentary perspective view illustrating a further modified embodiment.

FIG. 16 illustrates a still further modified form 140 based upon a modification of part 138. According to this modification, notches 142 are provided in opposite sides of the central region of the curved sections 126, 128, thereby changing the deformation characteristics.

Figure 17:
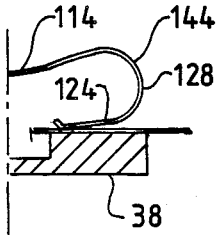
FIG. 17 is a fragmentary front elevational view illustrating another form of modification.

In FIG. 17 a further modified part 144 is shown. This part is similar to part 138 except that the curved sections are bowed into a somewhat larger shape once again changing the deflection and deformation characteristics.

Figure 18:
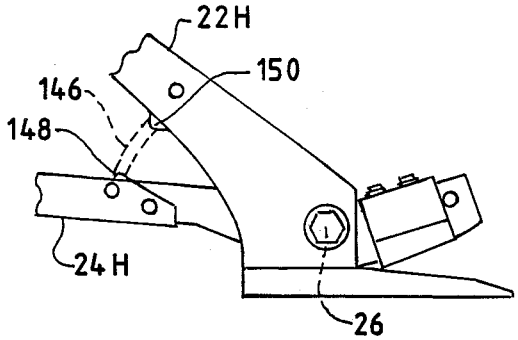
FIG. 18 is a fragmentary side elevational view illustrating an optional feature that may be incorporated in the tool.

FIG. 18 illustrates the incorporation of an optional feature into tool 20. This feature is a return spring 146 which provides a reopening force aiding reopening of the jaws after the tool has been operated to sever a piece of strapping. The spring is disposed in spaced relation to pivot 26 and acts between the two handles. Anchoring of the end of the spring to lower handle 24H is by means of a spring seat formation 148 in the middle of the three laminations of stack 56. The opposite end of the spring is anchored on the upper handle 22H by means of a spring seat 150 integrally formed in handle member 36.

The full open position of jaws 22J, 24J is defined by abutment of the rear edge of support plate 108 with the foreward edges of side members 32, 34. This is indicated generally by the numeral 152 in FIG. 1. By making the holes in support plate 108 slightly oversized in comparison to the shanks of screws 110, the position of plate 108 may be set to a desired position of adjustment before screws 110 are tightened so that the limit of opening occurs for a certain predetermined amount of opening of jaw 24J relative to jaw 22J. The shortest distance across this opening occurs just in front of throat 52 and is set, via the aforedescribed adjustment of support plate 108 to accommodate the maximum thickness of strapping that is to be cut. In this way, the actual cutting action on a piece of strapping that is fully inserted into the fully opened jaws will occur as early as possible during the operation of the handles where greater manual forces are typically generated. The maximum degree of closing of the jaws is established by abutment of the chamfered surfaces 154 of handle member 54 with the lower edges of side members 32, 34, as indicated by the reference numeral 156 in FIG. 1.

If necessary, the tool can be disassembled for resharpening either or both edges 64 and 86. Although the cutting blade element 58 has been described as being riveted to the other two elements 60, 62, it is contemplated that removable fasteners such as screws could be used instead. In this way, the blade element itself could be removed and resharpened or alternatively replaced by a fresh blade element.

Figure 19:
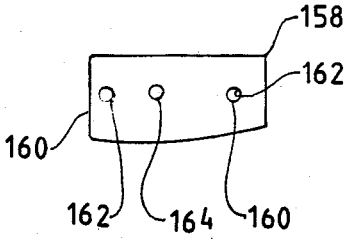
FIG. 19 is a view of a blade modification.

Still further, it is contemplated that the cutting blade could be a replaceable insert 158 such as the one illustrated in FIG. 19. This embodiment shows the blade shape generally similar to the shape of jaw 24J that appears in FIG. 1. The stack 56 still has the lamination elements 60 and 62 (although these two could conceivably be one piece). An additional piece, in cooperation with the insert, have a combined shape like the blade shape shown in FIG. 10. Thus, there is still a lamination that pivotally mounts in the same manner previously described for assembly 24. However, the replaceable inserted blade removably fastens to this stack alongside the forward portions of the stack constituting the upper jaw 24J.

A preferred manner of attachment comprises a pair of spaced apart hardened pins 160 that are fitted to the two forward holes in the two members 60, 62 and which project to fit into registering holes 162 in the inserted blade. There is one additional hole 164 that provides for use of a screw (not shown) to removably attach the insert to the stack. The use of close fitting hardened pins serves to react the cutting loads imposed during usage of the cutting tool. The fastener screw does not react nearly the same magnitude of loads but rather serves to keep the blade insert forced against the stack.

The foregoing description has disclosed and illustrated improvements in a strap cutting tool. Certain improvements are specific to the strap cutting tool while others can be used in various pliers-type tools, including a strap cutting tool. While a preferred embodiment has been disclosed, it will be appreciated that principles are applicable to other embodiments.

I claim:

1. In a work performing tool that has a working jaw mechanism operated by a pair of pivotally connected handles that are squeezed to operate the working jaw mechanism, the improvement which comprises one of said handles comprising an elongate non-metallic handle member forming a major portion of said one handle and a pair of elongate metallic members laterally sandwiching said non-metallic handle member in covering relation to at least a portion of each side of said non-metallic handle member, said metallic members being organized and arranged relative to said non-metallic handle member to form a throat that is bounded laterally by said metallic members and is free of said non-metallic handle member, and the pivotal connection between the pair of handles comprises a pivot connection that passes through said throat free of said non-metallic handle member, means joining said metallic members to said non-metallic handle member, and means attaching said metallic members to a portion of the working jaw mechanism that is operated by the handles.

2. The improvement set forth in claim 1 in which a portion of the other of said handles is disposed in said throat so as to be laterally bounded by said metallic members, and said pivot connection passes through a hole in said portion of said other handle to thereby pivotally connect said other handle relative to said one handle within said throat.

3. The improvement set forth in claim 2 in which said pivot connection comprises a fastening mechanism that is drawn tight against opposite sides of said metallic members so that during operation of the working mechanism via said handles, said fastening mechanism does not rotate relative to said one handle but rather said other handle rotates about said fastening mechanism.

4. The improvement set forth in claim 2 in which said portion of said other handle comprises a stack of metal laminations side-by-side and laterally fitted closely within said throat, said stack also projecting out of said throat on the side of said pivot connection opposite said other handle, and one of said laminations of said stack that projects out of said throat comprising a blade forming a portion of the working jaw mechanism of the tool.

5. The improvement set forth in claim 4 in which said other handle comprises a metal grip portion comprising an elongate channel having throat fitting closely onto and joined to the stack of laminations.

6. The improvement set forth in claim 4 in which said blade is of a material that is harder than the material of the other laminations of said stack.

7. The improvement set forth in claim 1 in which said portion of the working jaw mechanism to which said metallic members are attached comprises a slot having laterally spaced apart sides, said one handle being fitted to said slot such that said sides of said slot laterally bound said side members and said throat of said one handle, said metallic members having flanges that project laterally outwardly beneath said portion of the working jaw mechanism beyond each side of said slot, and in which said means attaching said metallic members to said portion of the working jaw mechanism comprises fastening means acting between each of said flanges and said portion of the working jaw mechanism to secure said flanges in abutment with said portion of the working jaw mechanism.

8. The improvement set forth in claim 7 in which said portion of the working jaw mechanism comprises an anvil member that has a cutting edge that extends forwardly from said slot in laterally inwardly spaced relation to one side of said slot by an amount essentially equal to the thickness of one of said metallic members, said one metallic member being essentially in abutment with said one side of said slot, and said working mechanism further comprising a cutting blade associated with said other handle and projecting from said throat immediately adjacent said one metallic member to provide for coaction with the cutting edge in the anvil member.

9. The improvement set forth in claim 8 in which said flange of said one metallic member joins with said metallic member by means of a curved bend, and a chamfer is provided in said anvil member along a lower edge of said one side of said slot to allow clearance for said curved bend so that both said flange of said one metallic member and a portion of said one metallic member that is immediately contiguous said curved bend opposite said flange of said one metallic member can be in abutment with said anvil member.

10. The improvement set forth in claim 8 in which said anvil member is an investment casting having a tapered forward portion to facilitate engagement of the working jaw mechanism with work, said tapered forward portion having flat surface portions that are bridged by rounded surface portions that are formed during the investment casting process.

11. The improvement set forth in claim 1 in which said portion of the working jaw mechanism comprises an anvil having a cutting edge, and the tool comprises a cutting blade associated with the other of said handles, said cutting blade and said cutting edge being disposed for coaction with each other, when the handles are squeezed together, to perform a servering operation on tensioned strapping placed in the working jaw mechanism, and said tool further including energy absorbing means mounted on said blade for absorbing energy which is released upon severing of tensioned strapping cut by the tool via said working jaw mechanism, said energy absorbing means comprising resilient metallic means having a laterally extending support portion attached to the top of said blade, respective pad portions that are disposed below said laterally extending support portion on opposite lateral sides of the blade and that confront respective portions of the anvil, and joining portions that join the respective pad portions with said laterally extending support portion, said pad portions being disposed for engaging the strapping and pressing it against said anvil portions on opposite sides of the working jaw mechanism as the handles are being squeezed together, said resilient metallic means resiliently deforming as the handles are being squeezed together, and upon completion of servering of the strapping, a substantial portion of the energy that has been stored in the strapping is released into the resilient metallic means by further deformation thereof.

12. The improvement set forth in claim 11 in which each joining portion comprises a corresponding curved section of the resilient metallic means.

13. The improvement set forth in claim 12 in which each curved section has essentially the same width as the corresponding pad portion, and notch structure is formed in each curved section reducing the width thereof.

14. The improvement set forth in claim 12 in which each curved section is disposed laterally outwardly of said support portion and the corresponding pad portion.

15. The improvement set forth in claim 12 in which each curved section is disposed forwardly of said support portion and the corresponding pad portion.

16. The improvement set forth in claim 11 in which curved lips are provided on certain free edge portions of said pad portions.

17. The improvement set forth in claim 16 in which said curved lips are provides on laterally inner and on rearward free edge portions of said pad portions.

18. The improvement set forth in claim 1 in which said one handle comprises recesses in the respective sides of said non-metallic handle member whose depths are essentially the same as the respective thicknesses of said metallic members, and respective portions of said metallic members are in-laid into the respective recesses so as to be substantially flush with said non-metallic handle member.

19. The improvement set forth in claim 18 in which the respective portions of said metallic members that are in-laid into the respective recesses form, in cooperation with said non-metallic handle member, a gripping portion of said one handle, and along the length of said gripping portion, an upper edge of each of said metallic members is disposed against a corresponding edge of the corresponding recess.

20. The improvement set forth in claim 19 in which along the length of said gripping portion, said non-metallic handle member protrudes upwardly beyond said edges of said recesses and has a laterally rounded upper surface.

21. The improvement set forth in claim 20 in which said non-metallic handle member comprises a raised stop at the forward end of said gripping portion and at the distal end is in covering relation to the distal ends of said metallic members.

22. The improvement set forth in claim 18 in which the widths of said metallic members are generally uniform along the length of said gripping portion, but are of progressively increasing widths forwardly of said gripping portion toward the working jaw mechanism.

23. The improvement set forth in claim 22 in which each of said metallic members has two points of attachment to said non-metallic handle member along said gripping portion, and two additional points of attachment to said non-metallic handle member forwardly of said gripping portion.

24. In a cutting tool for cutting tensioned strapping comprising a cutting mechanism operated by a pair of handles that are squeezed together to sever the strapping, said cutting mechanism comprising a blade associated with one of said handles and an anvil associated with the other of said handles, said anvil and blade constituting the cutting mechanism, the improvement for absorbing energy that is released upon severing of the strapping which comprises resilient metallic means comprising a laterally extending support portion attached to the blade, respective pad portions that are disposed below said laterally extending support portion on opposite lateral sides of the blade and that confront respective portions of the anvil, and joining portions that join the respective pad portions with said laterally extending support portion, said pad portions being disposed for engaging the strapping and pressing it against said anvil portions on opposite sides of the cutting mechanism as the handles are being squeezed together, said resilient metallic means resiliently deforming as the handles are being squeezed together, and upon completion of severing of the strapping, a substantial portion of the energy that has been stored in the strapping is released into the resilient metallic means by further deformation thereof.

25. The improvement set forth in claim 24 in which each joining portion comprises a corresponding curved section of the resilient metallic means.

26. The improvement set forth in claim 25 in which each curved section has essentially the same width as the corresponding pad portion, and notch structure is formed in each curved section reducing the width thereof.

27. The improvement set forth in claim 25 in which each curved section is disposed laterally outwardly of said support portion and the corresponding pad portion.

28. The improvement set for in claim 25 in which each curved section is disposed forwardly of said support portion and the corresponding pad portion.

29. The improvement set forth in claim 24 in which curved lips are provided on certain free edge portions of said pad portions.

30. The improvement set forth in claim 29 in which said curved lips are provides on laterally inner and on rearward free edge portions of said pad portions.

31. In a work performing tool that has a working jaw mechanism operated bY a pair of pivotally connected handles that are squeezed to operate the working jaw mechanism, the improvement which comprises one of said handles comprising an elongate non-metallic handle member forming a major portion of said one handle and a pair of elongate metallic members laterally sandwiching said non-metallic handle member in covering relation to at least a portion of each side of said non-metallic handle member, means joining said metallic members to said non-metallic handle member, said metallic members and said non-metallic member cooperatively forming a gripping portion in which portions of said metallic members are in-laid into respective recesses in the sides of said non-metallic member, each recess having a depth essentially the same as the thickness of the corresponding metallic member so that the metallic members are substantially flush with the non-metallic member.

32. The improvement set forth in claim 31 in which along the length of said gripping portion, an upper edge of each of said metallic members is disposed against a corresponding edge of the corresponding recess.

33. The improvement set forth in claim 32 in which along the length of said gripping portion, said non-metallic handle member protrudes upwardly beyond said edges of said recesses and has a laterally rounded upper surface.

34. The improvement set forth in claim 33 in which said non-metallic handle member comprises a raised stop at the forward end of said gripping portion and at the distal end is in covering relation to the distal ends of said metallic members.

35. The improvement set forth in claim 34 in which the widths of said metallic members are generally uniform along the length of said gripping portion, but are of progressively increasing widths forwardly of said gripping portion toward the working jaw mechanism, and in which each metallic member has two points of attachment to said non-metallic handle member along said gripping portion and two additional points of attachment to said non-metallic handle member forwardly of said gripping portion.

36. The improvement set forth in claim 31 in which the other of said handles comprises an elongate metallic channel-shaped member having a throat whose lateral dimension is substantially the same as that of said non-metallic handle member of said one handle, said elongate metallic channel-shaped member forming a major portion of said other handle, and a stack of laminated elements extending forwardly of said elongate metallic channel-shaped member and laterally fitting closely within the throat thereof, said one handle comprising a throat that is forward of said gripping portion and laterally bounded by said metallic members of said one handle, said stack fitting laterally closely within said last-mentioned throat.

* * * * *